US006561380B1

(12) United States Patent
Suzuki

(10) Patent No.: US 6,561,380 B1
(45) Date of Patent: May 13, 2003

(54) PRODUCT DELIVERY DEVICE OF VENDING MACHINE

(75) Inventor: Minoru Suzuki, Saitama (JP)

(73) Assignee: Fuji Electric Co., Ltd., Kanagawa (JP)

( * ) Notice: Subject to any disclaimer, the term of this patent is extended or adjusted under 35 U.S.C. 154(b) by 0 days.

(21) Appl. No.: 09/807,273

(22) PCT Filed: Nov. 8, 2000

(86) PCT No.: PCT/JP00/05403

§ 371 (c)(1),
(2), (4) Date: May 30, 2001

(87) PCT Pub. No.: WO01/16903

PCT Pub. Date: Mar. 8, 2001

(30) Foreign Application Priority Data

Aug. 27, 1999 (JP) ..... 11-242129

(51) Int. Cl.[7] ..... G07F 11/16
(52) U.S. Cl. ..... 221/266; 221/258; 221/289
(58) Field of Search ..... 221/289, 266, 221/258, 195, 196

(56) References Cited

U.S. PATENT DOCUMENTS

| | | | | | |
|---|---|---|---|---|---|
| 772,226 | A | * | 10/1904 | Disbrow | 221/245 |
| 1,004,094 | A | * | 9/1911 | Sigley | 194/247 |
| 1,212,994 | A | * | 1/1917 | Odell | 221/266 |
| 1,626,429 | A | * | 4/1927 | Ruoff | 221/266 |
| 2,824,667 | A | * | 2/1958 | Barnett | 221/266 |
| 3,161,321 | A | * | 12/1964 | Million et al. | 221/266 |
| 4,308,974 | A | * | 1/1982 | Jones | 221/196 |
| 4,429,806 | A | * | 2/1984 | Schwarzli | 221/20 |
| 5,127,543 | A | * | 7/1992 | Meisels | 221/15 |
| 5,555,965 | A | * | 9/1996 | Mishina | 194/217 |
| D417,309 | S | * | 11/1999 | Morris | D27/184 |

FOREIGN PATENT DOCUMENTS

| | | | |
|---|---|---|---|
| GB | WO 86/07575 | * | 12/1986 |
| JP | 52-38917 | | 10/1977 |
| JP | 58-26736 | * | 2/1983 |
| JP | 06-3506 | | 1/1994 |
| JP | 07-93653 | | 4/1995 |

* cited by examiner

*Primary Examiner*—Donald P. Walsh
*Assistant Examiner*—Joseph C Rodriguez
(74) *Attorney, Agent, or Firm*—Sughrue Mion, PLLC

(57) ABSTRACT

A product delivery apparatus for a vending has a rotatable product delivery drum that includes a selling product supporting face disposed outside the rotation axis of the delivery drum and which is concaved in an arc form toward the rotation axis, and a next selling product supporting face which extends concetrically with respect to the rotation axis to support a product for next sale. A product passage has an enlarged-width section for permitting the passage of the product for sale.

7 Claims, 11 Drawing Sheets

PRODUCT DELIVERY DEVICE OF VENDING MACHINE

FIELD OF THE INVENTION

The invention relates to a product delivery apparatus for a vending machine, adapted for delivering at the time of selling downward a product for sale located lowermost among a plurality of products stored in a product passage in such a state that they are vertically stacked on top of one another.

BACKGROUND OF THE INVENTION

In general, a serpentine column, which is vertically extended in a serpentine state, has hitherto been applied to a product passage for a vending machine wherein products, for example, can beverage products or PET bottle products, are stored in such a state that they are vertically stacked on top of one another. A product delivery apparatus for delivering, at the time of selling, downward a product for sale only among a plurality of products stored in the column is provided at the lower end of the column. The product delivery apparatus provided in a conventional serpentine column comprises: a stopper which, under stand-by condition, supports the lowermost product for sale from the underside of the product for sale and, in addition, at the time of selling, supports a product for next sale, located just above the product for sale, from the underside of the product for next sale and, immediately after supporting the product for next sale, releases the support of the product for sale; a solenoid for driving the stopper; and the like.

Another product delivery apparatus known in the art is described in a microfilm of Japanese Utility Model Laid-Open No. 160575/1986. This product delivery apparatus comprises: a semi-cylindrical delivery member which, under stand-by condition, supports a product for sale from the underside of the product for sale in such a state that the lower half part of the product for sale is accommodated in the delivery member; and a drive motor for driving and rotating the delivery member at the time of selling, wherein, upon the rotation of the delivery member supporting the product for sale at about 180 degrees at the time of selling, the product for sale is delivered downward. The delivery member in the product delivery apparatus is constructed so that an adapter having a predetermined shape for raising can be mounted on the inner face of the delivery member according to the diameter of products to be sold. By virtue of the mounting of the adapter on the delivery member, even when products having a smaller diameter than the delivery member is sold, the delivery member can be smoothly rotated without raising products located above a product for next sale and can surely deliver the product for sale.

In the case of the product delivery apparatus provided in conventional serpentine columns, when there are a plurality of columns, the product delivery apparatus should be provided for each column. In addition, since a solenoid is used, the production cost is increased. On the other hand, in the case of the another conventional product delivery apparatus, products having various diameters can be delivered by mounting an adapter on the delivery member. However, several types of adapter should be provided according to products to be sold. Further, when the product to be sold is changed to products having a different diameter, troublesome adapter mounting work should be performed. There is also room for improvement in these points.

SUMMARY OF THE INVENTION

The invention has been made with a view to solving the above problems of the prior art, and it is an object of the invention to provide a product delivery apparatus for a vending machine which can be produced at a lower cost than the product delivery apparatus provided in conventional serpentine columns, and is advantageous in that products having various sizes can be surely delivered one by one without use of any adapter.

A product delivery apparatus for a vending machine defined by claim 1, adapted for delivering downward a product for sale located lowermost at the time of selling among a plurality of products stored in such a state that they lie sideways and are vertically stacked on top of one another, comprises:

- a vertically extended product passage for storing the plurality of products, defined by two vertically extended passage walls which have been disposed so as to face each other while leaving a predetermined space therebetween;
- a product delivery drum which is provided at the lower end of the product passage so as to be rotatable around an axis line horizontally extended in a direction orthogonal to the direction in which the two passage walls face each other and is extended along the axis line; and
- drive means which, at the time of selling, drives and rotates the product delivery drum at a predetermined angle to deliver the product for sale,
- said product delivery drum comprising: a first product supporting face which is disposed outside the axis line, is concaved in an arc form toward the axis line, and, under stand-by condition, supports the product for sale from the underside of the product for sale in such a state that the lower part of the product for sale is accommodated within the first product supporting face, while, at the time of selling, upon the rotation of the product delivery drum, the product for sale is delivered toward one of the two passage walls; and a second product supporting face, which is continued from the first product supporting face, is extended concentrically with respect to the axis line, and, at the time of selling, supports a product for next sale, from the underside of the product for next sale, located just above the product for sale,
- said product passage having an enlarged-width section at the lower end of one of the passage walls, for permitting the passage of the product for sale.

According to this construction, under stand-by condition, among a plurality of products stored in a product passage in such a state that they lie sideways and are vertically stacked on top of one another, the lowermost product for sale is supported from the underside of the product for sale by the first product supporting face in the product delivery drum in such a state that the lower part of the product for sale is accommodated in the first product supporting face. At the time of selling, as soon as the product delivery drum driven and rotated by drive means is rotated around the axis line, the first product supporting face is rotated around the axis line and consequently faces one of the passage walls, whereby the product for sale is delivered in the state of being supported by the first product supporting face to the enlarged-width section. Further, in this case, the second product supporting face is also rotated around the axis line and reaches beneath the product for next sale to support the product for next sale from the underside of the product for next sale. Upon the rotation of the product delivery drum to a predetermined angle, the product for sale is separated from the first product supporting face, passed through the enlarged-width section, and delivered downward. On the other hand, upon further rotation of the product delivery drum, the product for next sale supported by the second product supporting face is delivered from the second product supporting face to the first product supporting face, thereby permitting the product for next sale to be supported by the first product supporting face and to now become a product for sale.

Thus, according to the product delivery apparatus having the above construction, the product for sale is delivered by rotating the product delivery drum provided at the lower end of the product passage. This, unlike the prior art, can eliminate the need to use any solenoid, and can realize the production of the product delivery apparatus at a lower cost than the conventional product delivery apparatus provided in conventional serpentine columns. Further, for the product for sale and the product for next sale stored in the product passage, as described above, a certain range of size (for example, diameter), which can be supported by the first product supporting face and the second product supporting face, suffices for good results. Therefore, unlike the prior art, various products having the certain range of size can be surely delivered one by one without use of any adapter or the like.

The product delivery apparatus according to claim 1 defined by claim 2 may further comprises a product holding member which is constructed so as to be movable between a stand-by position facing, in a projected state, the enlarged-width section and a delivery position for permitting the passage of the product for sale, and, at the time of selling, is moved from the stand-by position toward the delivery position and holds the product for sale until the second product supporting face supports the product for next sale.

According to this construction, since the product holding member moved from the stand-by position toward the delivery position at the time of selling holds the product for sale until the second product supporting face supports the product for next sale, the product for next sale remains stacked on top of the product for sale and is supported from its underside by the product for sale, thereby preventing downward movement to an extent more than necessary. That is, at the time of selling, even though the product for next sale approaches the first product supporting face, the distance between the product for next sale and the axis line does not become shorter than the distance between the second product supporting face and the axis line. Therefore, the product for next sale is not caught in the end of the first product supporting face. This permits the product delivery drum to be smoothly rotated to properly deliver the product for sale.

In the product delivery apparatus according to claim 2 defined by claim 3, the product holding member may be provided so as to be rotatable relative to the product delivery drum around the axis line, and which may further comprise holding member drive means which, when the product holding member is moved to the delivery position to deliver the product for sale, drives the product holding member from the delivery position to the stand-by position.

According to this construction, at the time of selling, as soon as the product holding member is moved, upon the rotation of the product delivery drum, to a delivery position to deliver the product for sale, the product holding member is driven from the delivery position to the stand-by position by the holding member drive means. Therefore, upon further rotation of the product delivery drum, the product holding member is not moved beyond the delivery position to a position opposite to the stand-by position. This can eliminate the need to provide a space for the movement of the product holding member to a position opposite to the enlarged-width section, that is, until the product delivery drum is located between the enlarged-width section and the product holding member. Therefore, the product delivery drum can be disposed near one passage wall facing the other passage wall. This can realize saving of a space of the product passage around the product delivery drum.

This product delivery apparatus according to claim 3 defined by claim 4 may be constructed so that a product holding member is constructed to be rotatable toward the delivery position upon being pushed by the weight of the product for sale, a stopper is further provided which inhibits the rotation of the product holding member toward the delivery position at a predetermined angle or more to the product delivery drum, and said holding member drive means is formed of a spring which energizes the product holding member to the stand-by position.

According to this construction, the product holding member is constructed so as to be rotatable toward the delivery position upon pressing by the weight of the product for sale (self-weight). Therefore, the rotation of the product holding member by an angle according to the size of the product permits the product for sale supported by the first product supporting face to be properly held independently of the size of the product. That is, in the case of holding of the product for sale in such a state that the lower part of the product for sale is accommodated in a space defined by the first product supporting face and the product holding member, when the space is smaller than the lower part of the product for sale, pressing of the product for sale against the product holding member permits the space to be automatically increased to a size suitable for the lower part of the product for sale. The spring constituting the holding member drive means, when the product holding member is energized to the stand-by position, remains the product for sale in contact with the product holding member. Further, the stopper inhibits the rotation of the product holding member toward the delivery position at a predetermined angle or more to the product delivery drum. Thus, under stand-by condition and under selling condition, the product for sale can be automatically properly held according to the size of the product for sale. Further, as described above, when the holding member drive means is constituted by a spring, the holding member drive means has both the function of driving the product holding member to the stand-by position and the function of allowing the product holding, member to always be in contact with the product for sale. This can simplify the structure and can reduce the cost.

In the product delivery apparatus according to any one of claims 2 to 4 defined by claim 5. The product holding member may comprise: a first projection which extends along the axis line and is projected toward the enlarged-width section to a first projection length; and a second projection which is adjacent to the first projection, extends along the axis line, and is projected toward the enlarged-width section to a second projection length shorter than the first projection length.

According to this construction, at the time of selling, disposition and supporting of two products for sale having the same size on the first product supporting face of the product delivery drum along the axis line so as to be supported respectively by the first projection and the second projection permit the two products to be delivered at different rotation angles of the product delivery drum before the product delivery drum makes one revolution. More specifically, at the time of selling, upon the rotation of the product delivery drum, the second projection projected to a second projection length first reaches the delivery position, whereby the product for sale held by the second projection is delivered. The product delivery drum is allowed to remain stopped in this state, and, upon further rotation of the product delivery drum in next selling, the first projection reaches the delivery position, whereby the product for sale held by the first projection is delivered. Therefore, before the product delivery drum makes one revolution, one product can be delivered in each of the two selling operations. As compared with the case where one product is sold for each revolution of the product delivery drum, this can reduce the power consumption for rotating the product delivery drum at the time of selling.

In the product delivery apparatus according to any one of claims 1 to 5 defined by claim 6, an entry inhibition member may be further provided on one of the passage walls. The entry inhibition member is constructed so as to be movable between a position of retraction from the enlarged-width section and a position of projection toward the enlarged-width section, and, at the time of selling, upon the rotation of the product delivery drum, is moved from the retraction position to the projection position to inhibit the entry of the product for next sale into the enlarged-width section.

According to this construction, at the time of selling, upon the rotation of the product delivery drum, the entry inhibition member is moved from the retraction position to the projection position to inhibit the entry of the product for next sale into the enlarged-width section. This can surely prevent the product for next sale from accidentally entering the enlarged-width section at the time of selling. As a result, the so-called "delivery of two products at a time" can be surely prevented wherein two products are delivered in a single selling operation.

The product delivery apparatus according any one of claims 1 to 6 defined by claim 7 may be constructed so that the product passage is composed of two product passages each having the product delivery drum and adjacent to each other, and the drive means comprises a single drive source and connection switch means which, at the time of selling, performs selective switching to any one of the product delivery drums in the two product passages and connects the drive source to the selected product delivery drum.

According to this construction, a single drive source as the drive means is connected to any one of the product delivery drums, selected by switching through connection switch means, in the two product passages adjacent to each other. Therefore, a single drive source can be used for driving both the product delivery drums. By virtue this construction, the product delivery apparatus can be produced at a lower cost than the product delivery apparatus wherein a drive source is provided for each of the product delivery drums.

BRIEF DESCRIPTION OF THE DRAWINGS

The invention will be explained in more detail in conjunction with the appended drawings, wherein.

DESCRIPTION OF THE PREFERRED EMBODIMENTS

The preferred embodiments of the invention will be explained in more detail in conjunction with the accompanying drawings.

Figure 1:
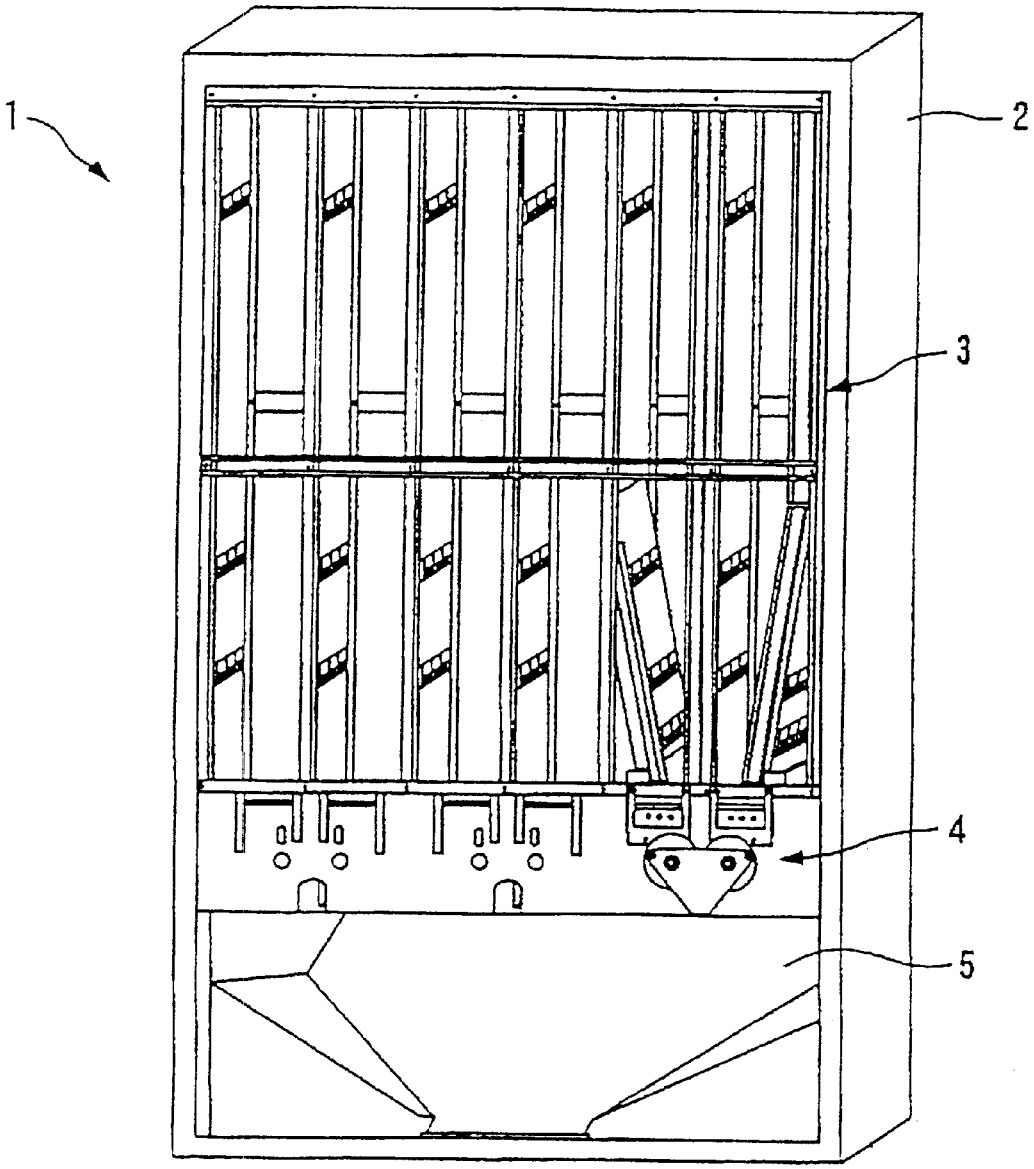
FIG. 1 is a perspective view showing the interior of a vending machine including a product storage-delivery apparatus, provided with a product delivery apparatus according to one preferred embodiment of the invention, incorporated into a vending machine body, a main door and an insulating door being not shown.
Figure 2:
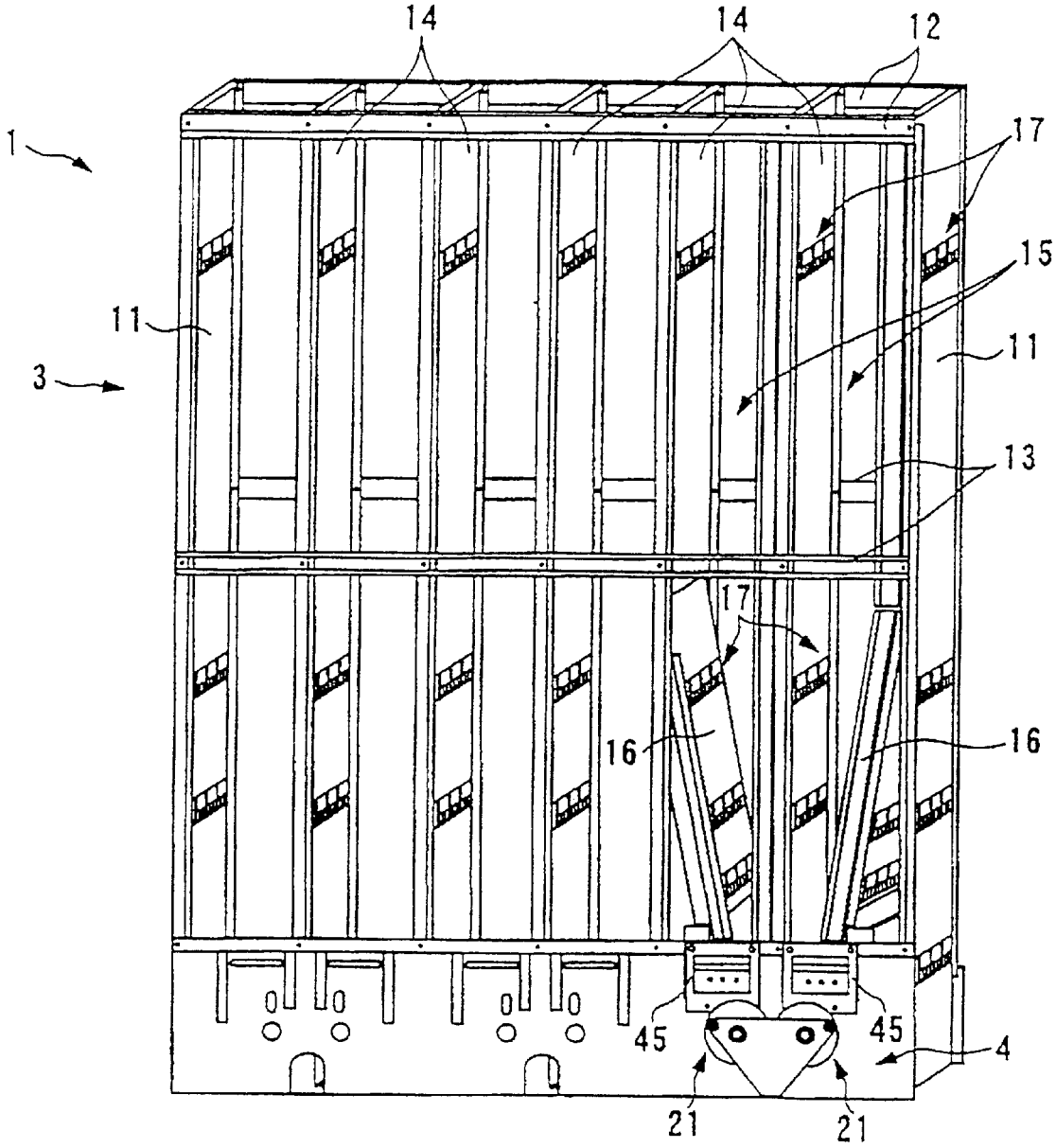
FIG. 2 is a perspective view of a product storage-delivery apparatus.

FIGS. 1 and 2 show a product storage-delivery apparatus having in its lower part the product delivery apparatus according to one preferred embodiment of the invention, wherein FIGS. 1 and 2 respectively show the incorporation of the product storage-delivery apparatus into the body of the vending machine and the whole appearance. In the vending machine with the product storage-delivery apparatus being incorporated thereinto, a large number of products, for example, can beverage products or PET bottle products, are stored in such a state that they lie sideways and are vertically stacked on top of one another, and, at the time of selling, the product delivery apparatus delivers the lowermost product for sale downward one by one.

Two sets of product storage-delivery apparatuses 1 are disposed in a longitudinal box vending machine body 2 having a opened front face respectively in its front and back. In FIGS. 1 and 2, only the product storage-delivery apparatus on the front side is shown. Each product storage-delivery apparatus 1 comprises a product storage apparatus 3 for storing a large number of products and a product delivery apparatus 4 which is located below the product storage apparatus 3 and, at the time of selling, delivers the lowermost product for sale. In the product storage-delivery apparatuses 1 shown in FIGS. 1 and 2, for convenience, various components in the right end portion are shown in detail, and components in the left portion are the same as those in the right end portion and hence are not shown. Therefore, in the following description, the construction of the product storage-delivery apparatus 1 in its right end portion will be mainly explained.

As shown in FIG. 2, the product storage apparatus 3 has a frame comprising: vertically long rectangular left and right frames 11, 11 disposed while leaving a space substantially equal to the internal length of the vending machine body 2 in its left and right directions and so as to face each other in the left and right directions; laterally long rectangular upper frames 12, 12 which provide a bridge between the upper ends of the left and right frames 11, 11 and are screwed on the left and right frames 11, 11 so as to be symmetrical with respect to the front and the back; and laterally long rectangular central frames 13, 13 which provide a bridge between the center portions of the left and right frames 11, 11 in the vertical direction and are screwed on the left and right frames 11, 11 so as to be symmetrical with respect to the front and the back; and the like. Five vertically long rectangular partition walls 14 (passage walls) having substantially the same construction as the left and right frames 11 are disposed between the left and right frames 11, 11 at equal intervals in the left and right directions. Six vertically extended product passages 15 are defined by adjacent partition walls 14, 14 and by left and right frames 11, 11 and partition walls 14, 14 adjacent respectively to the left and right frames 11, 11. In each of the product passages 15, a large number of products of an identical item are stored in such a state that they are allowed to lie sideways in a lengthwise direction and are vertically stacked on top of one another. Since this vending machine has two sets of front and back product storage-delivery apparatuses 1, the vending machine can sell products of up to 12 (=6×2) items.

Figure 3:
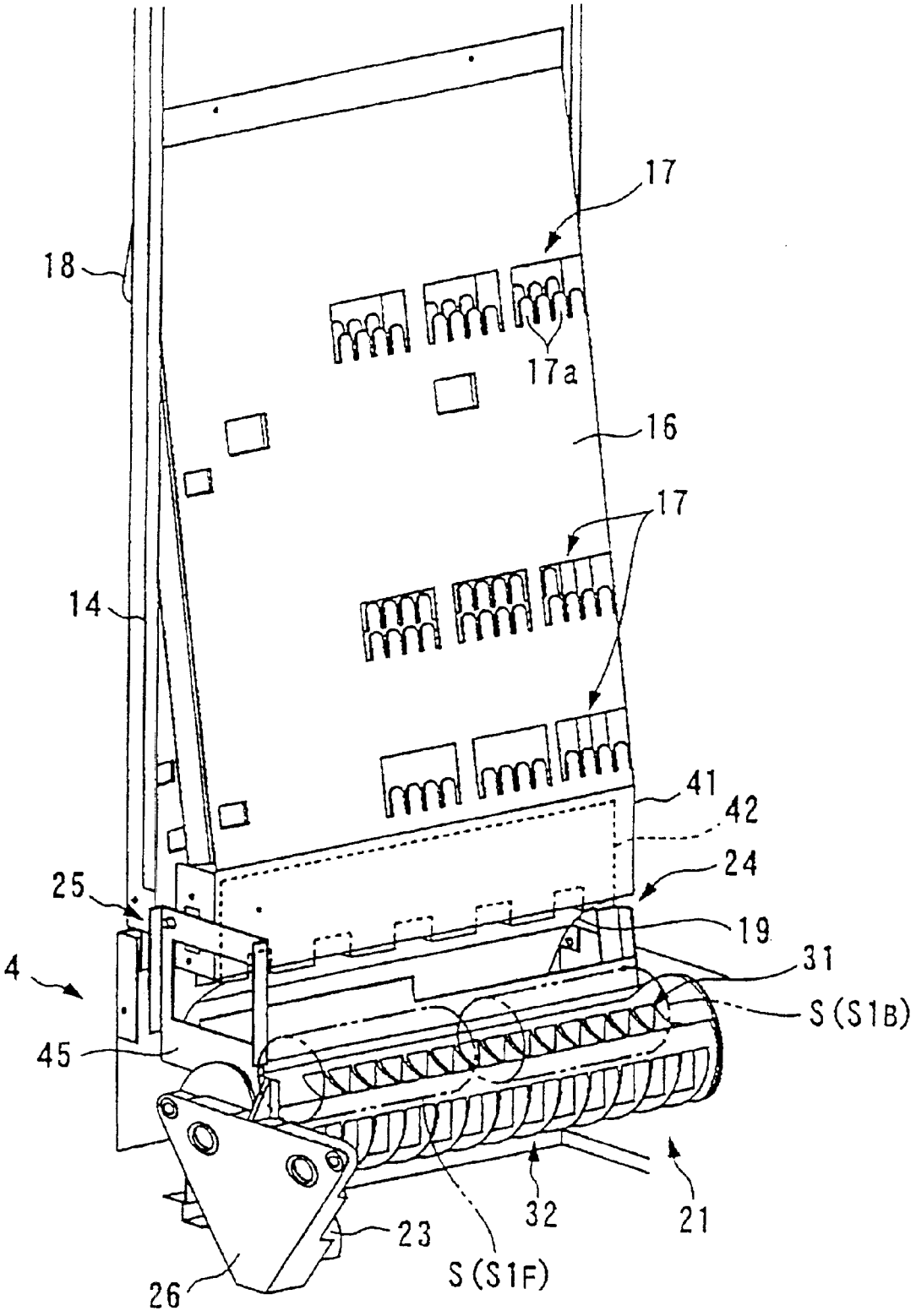
FIG. 3 is a perspective view showing a portion around a product delivery drum.

A guide wall 16 for guiding the stored product to a product delivery drum 21 described below is provided in the lower half portion in each of the product passages 15. As shown in FIG. 3, this guide wall 16 is in a vertically long rectangular form having a width substantially equal to the width of the partition wall 14 in its front and back directions, and is mounted in such a state that the guide wall 16 is inclined rightward or leftward toward the product delivery drum 21 to the vertically extended partition wall 14 and the right frame 11 (including the left frame; the same shall apply hereinafter), and is allowed to stand against the partition wall 14 and the right frame 11. This permits the width of the product passage 15 in its left and right directions to be reduced downward, and permits the products to be properly delivered one by one to the product delivery drum 21. Three locking sections 17, 17, 17 for locking a vertically extended passage partition plate (not shown) having a predetermined shape for dividing the product passage 15 into two passages, front and back passages, are provided at proper intervals in the vertical direction on the front and back sides of the guide wall 16, that is, on the product passage 15 side and the partition wall 14 side (including the right frame 11 side), in its second half portion in the front and back directions. Each of the locking sections 17 has a plurality of locking claws 17*a* adjacent to one another in the front and back directions, and is constructed so that the end of the passage partition plate in the left and right directions can be inserted into between adjacent locking claws 17*a*, 17*a* in each of the locking sections 17. The partition wall 14 and the right frame 11 also have a plurality of locking sections 17, which are of the same type as in the guide wall 16, vertically provided at proper intervals. Therefore, the locking of a passage partition plate in each of the locking sections 17 of the guide wall 16 and the partition wall 14 (including the right frame 11) permits the product passage 15 to be vertically divided into two passages, front and back passages. In addition, properly varying the locking position of the passage partition plate in the front and back directions enables the width of the front and back passages in the front and back directions to be made equivalent to the height of the product to be stored (the height before the product is allows to lie lengthwise).

The guide wall 16 can be easily attached to or detached from the partition wall 14 and the like through a hook 18 provided in the upper part. By virtue of this construction, for example, in the case of performing maintenance of the product storage-delivery apparatus 1 disposed in the inner part of the vending machine body 2, removing the guide wall 16 from the partition wall 14 and the like permits the worker to easily access the product storage-delivery apparatus 1 in the inner part of the vending machine body 2. This facilitates the maintenance work.

Figure 4:
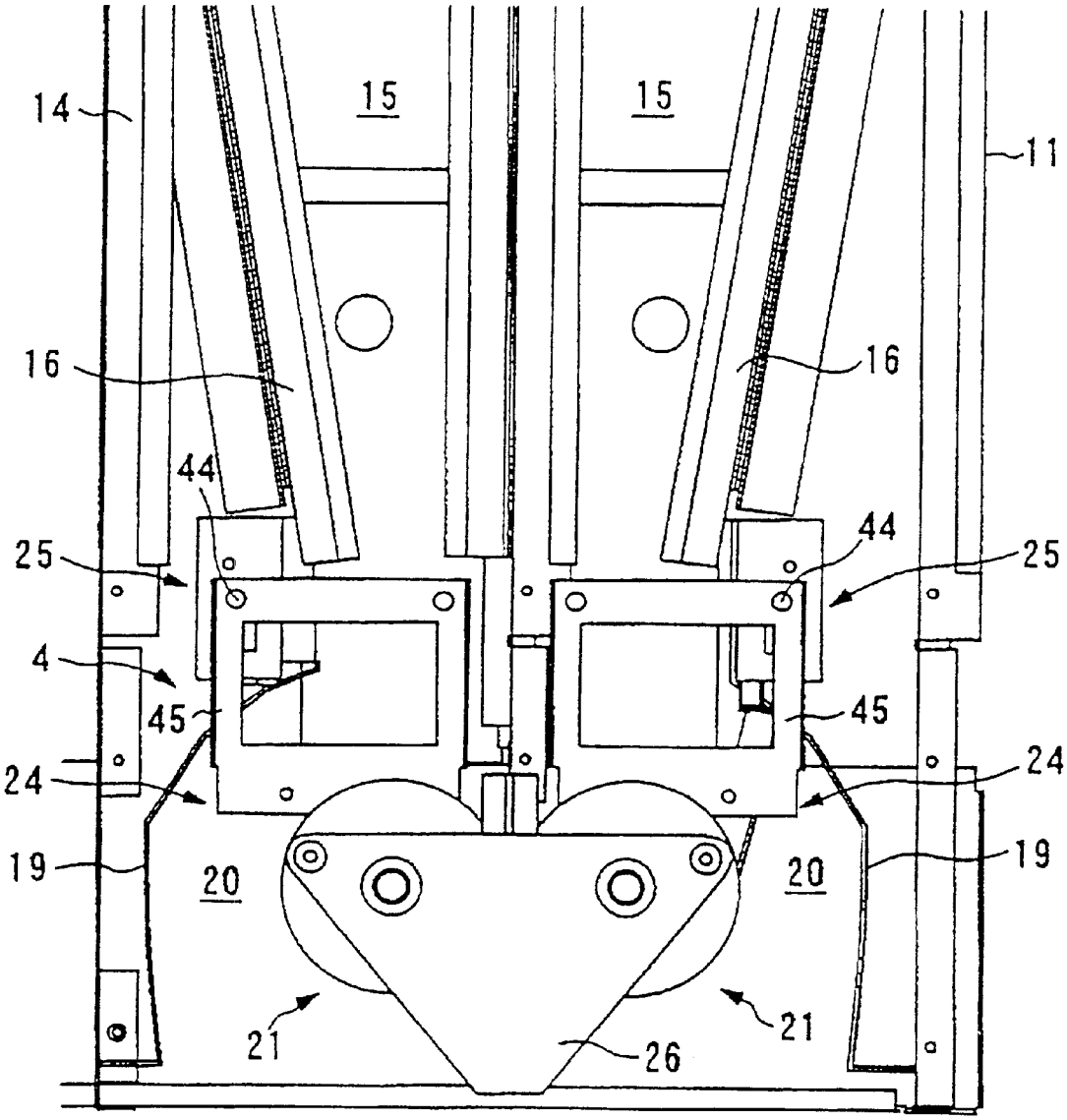
FIG. 4 is a front view showing a portion around two left and right adjacent product delivery drums.

As shown in FIGS. 3 and 4, an enlarged-width plate 19, which is extended in the front and back directions, is curved in a convex form from below the guide wall 16 to a portion opposite to the product delivery drum 21, and is extended downward close to the partition wall 14 side, is provided in the lower end of the partition wall 14 on which the guide wall 16 is mounted. An enlarged-width plate 19 is also provided symmetrically with respect to the enlarged-width plate 19 in the lower end of the right frame 11. Each enlarged-width plate 19 and each product delivery drum 21 constitute the lower end of the product passage 15 and, at the same time, define an enlarged-width section 20 which, at the time of selling, permits passage of a product S for sale and delivers the product S for sale downward.

On the other hand, as shown in FIGS. 3 and 4, the product delivery apparatus 4 comprises: the above product delivery drum 21 which is rotatably provided at the lower end of each product passage 15, holds the product S for sale at the time of stand-by, and, at the time of selling, is rotated in a predetermined direction to deliver the product S for sale downward and at the same time to hold the product for next sale located just above the product for sale; a drive motor 23 (a drive source) which, at the time of selling, selectively drives and rotates any one of the two product delivery drums 21, 21 adjacent to each other in the left and right directions; a product holding mechanism 24 which, at the time of selling, holds the product S for sale until the product delivery drum 21 holds the product for next sale; an entry inhibition mechanism 25 which, at the time of selling, inhibits the entry of the product for next sale into the enlarged-width section 20; and the like.

In the product delivery apparatus 4, the components except for the drive motor 23, that is, the product delivery drum 21, the product holding mechanism 24, and the entry inhibition mechanism 25, are provided for each of the product passages 15. As shown in FIG. 4, these are provided so as to be symmetrical with respect to the left and the right. Therefore, the components disposed on the left side will be mainly described.

Figure 5:
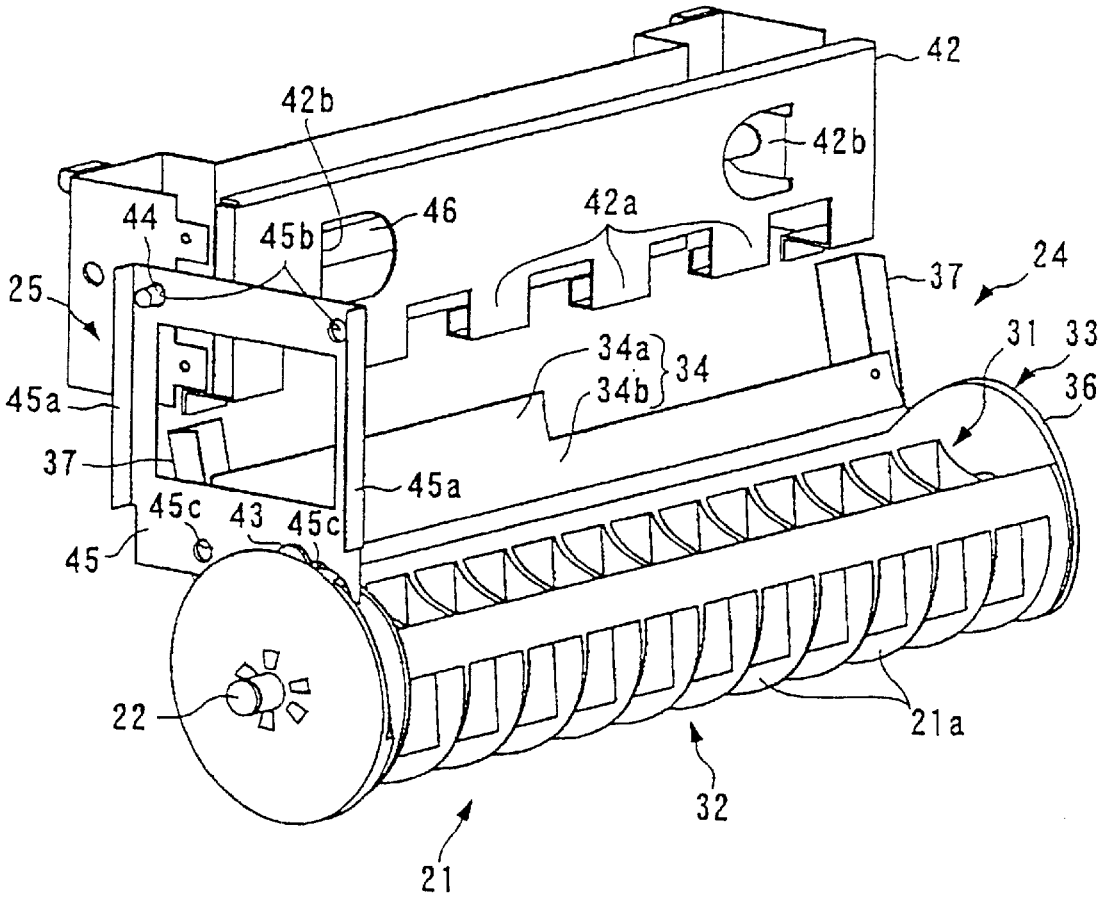
FIG. 5 is an enlarged perspective view showing a portion around a product delivery drum.
Figure 6:
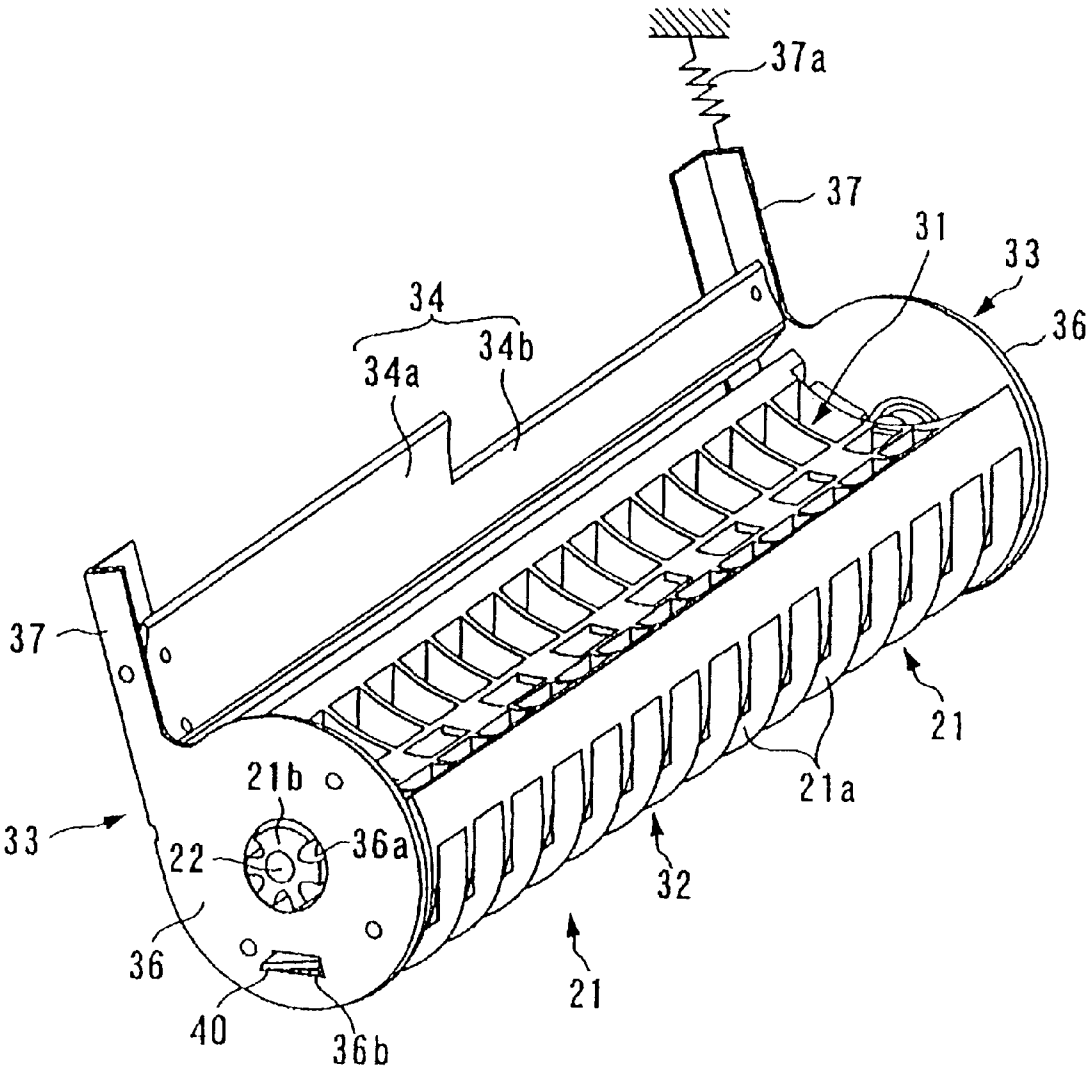
FIG. 6 is a perspective view of a product delivery drum with a product holding mechanism incorporated thereinto.
Figure 7:
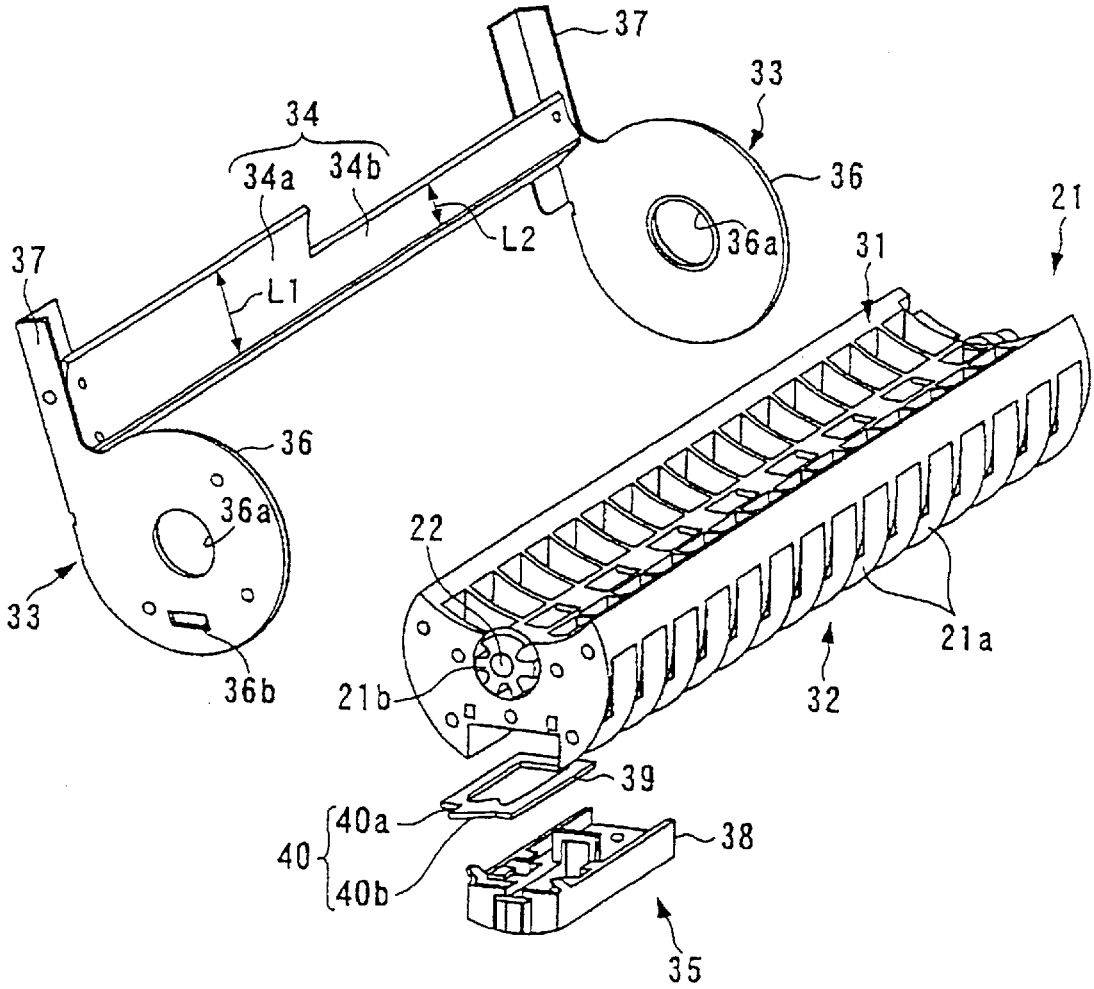
FIG. 7 is an exploded perspective view showing a product holding mechanism and a product delivery drum.

As shown in FIGS. 5 to 7, the product delivery drum 21 is formed in a substantially cylindrical form, which is horizontally extended in the front and back directions, by jointing together a large number of ribs 21*a* having a predetermined shape disposed at predetermined intervals in the front and back directions. The outer surface, in the circumferential direction of the product delivery drum 21, constituted by the peripheral face of the large number of ribs 21*a* comprises a selling product supporting face 31 for supporting a product S for sale (a first product supporting face) and a next selling product supporting face 32 for supporting a product for next sale (a second product supporting face). The selling product supporting face 31 is disposed at a position which is outer than a rotation axis 22 (a shaft line) extended horizontally in the front and back directions, and the visual outline cut in a direction orthogonal to the rotation axis 22 is formed in an arc form concaved toward the rotation axis 22. On the other hand, the next selling product supporting face 32 is continued from the ends of the selling product supporting face 31, and, at the same time, is extended concentrically with the rotation axis 22, and the visual outline cut in a direction orthogonal to the rotation axis 22 is formed in a superior arc. As shown in FIG. 7, a stopper 35 for the product holding mechanism 24 described below is provided in the front portion at the lower end of the product delivery drum 21.

As shown in FIG. 3, a drive motor 23 is provided around the front end of the product delivery drum 21, and is connected to the rotation axis 22 of the product delivery drum 21 through a drive mechanism (connection switching means) (not shown) within a triangular case 26 provided in the front of the product delivery drum 21. This drive mechanism is constituted, for example, by two one-way clutches. The positive or reverse rotation of the drive motor 23 at the time of selling permits any one of the two product delivery drums 21, 21 adjacent to each other in the left and right directions to be selectively switched and to be driven and rotated in a predetermined direction. More specifically, in FIG. 4, the left product delivery drum 21 is driven and rotated anti-clockwise while the right product delivery drum 21 is driven and rotated clockwise.

Thus, the drive mechanism selectively drives any one of the left and right product delivery drums 21, 21 by power of the single drive motor 23. As compared with the provision of a drive motor 23 for each of the product delivery drums 21, 21, this can reduce the production cost of the product delivery apparatus 4.

Under usual stand-by condition, the product delivery drum 21 having the above construction is located in a home position such that the selling product supporting face 31 faces upward. In this case, the product delivery drum 21 supports the product S for sale from the underside of the product for sale with the lower part of the product S for sale being accommodated in the drum 21 (see FIG. 8A). At the time of selling, as soon as the drive motor 23 drives and rotates anti-clockwise the product delivery drum 21 in FIG. 3, the selling product supporting face 31 faces left to deliver the product S for sale to the enlarged-width section 20. Upon the rotation of the product delivery drum 21 to a position where the enlarged-width section 20 permits the passage of the product S for sale, the product S for sale is passed through the enlarged-width section 20, and is delivered downward.

As shown in FIGS. 6 and 7, the product holding mechanism 24 comprises: a pair of front and back rotation members 33, 33 having a predetermined shape which are provided rotatably relative to the product delivery drum 21 respectively at the front end and back end of the product delivery drum 21; a product holding member 34 which provides a bridge between the rotation members 33, 33 and, in this state, is projected from around the peripheral surface of the product delivery drum 21 toward the enlarged-width section 20 and, at the time of selling, supports the product S for sale, from the underside of the product, delivered to the enlarged-width section 20 upon the rotation of the product delivery drum 21; and a stopper 35 for preventing the rotation of the product holding member 34 relative to the product delivery drum 21 at an angle exceeding a predetermined angle.

Each of the rotation members 33 is in a disk form and has in its center a through-hole 36*a*. A projected bearing 21*b* of the product delivery drum 21 is loosely inserted into the through-hole 36*a*. Thus, the rotation member 33 comprises: a disk 36 which is rotatable relative to the product delivery drum 21; and a support 37 which is extended upward from a predetermined position of the periphery of the disk 36, has an L shape in cross section, and supports the product holding member 34 in its end. The front end of the support 37 in the rotation member 33 on the back side is provided with a pulling spring 37*a* (holding member drive means, spring). The pulling spring 37*a* energizes the product holding member 34 to a stand-by position P1 described below (see FIG. 8A) through the rotation members 33, 33. A laterally long rectangular through-hole 36*b* is provided at the lower part of the disk 36. A stopper body 39 of the stopper 35 described below is attached to or detached from the through-hole 36*b*.

The product holding member 34 extends in front and back directions along the rotation axis 22 of the product delivery drum 21, and the front and back ends of the product holding member 34 are screwed respectively to the supports 37, 37 in the front and back rotation members 33, 33. The face on the product delivery drum 21 side of the product holding member 34 is slightly concaved in an arc form having a small curvature and, when the product S for sale is supported, can properly hold the product S for sale. The product holding member 34 is constructed to be rotatable around the rotation axis 22 between a stand-by position P1 projected toward the enlarged-width section 20 (see FIGS. 5 and 8A) and a delivery position P2 which, upon pressing by the weight of the product S for sale (self-weight), permits the passage of the product S for sale through the enlarged-width section 20 (see FIG. 8E). For the product holding member 34, the first half portion 34*a* (first projection) and the second half portion 34*b* (second projection) are different from each other in the length of projection from around the product delivery drum 21 toward the enlarged-width section 20. More specifically, the projection length L2 (second projection length) in the second half portion 34*b* is shorter than and is approximately half the projection length L1 (first projection length) in the first half portion 34*a*.

As shown in FIG. 7, the stopper 35 has a stopper body 39, formed of a plate material and having a predetermined shape, which is mounted movably in the front and back directions at the lower part of the front end in the product delivery drum 21 through a case 38, and a spring (not shown) which energizes the stopper body 39 forward. The front end (a locking section 40) of the stopper body 39 is projected in a wedge form and comprises: a locking face 40*a* which straightly extends forward and has a face parallel to the left edge face of the through-hole 36*b* in the front rotation member 33; and an inclined face 40*b* which is continued from the front end of the locking face 40*a* and is inclined backward. The stopper body 39 is energized forward by the spring not shown. As shown in FIG. 6, under stand-by condition, this permits the locking section 40 to be inserted into and engaged with the through-hole 36*b* in the front rotation member 33.

In the product holding mechanism 24 having the above construction, at the time of selling, as soon as the product delivery drum 21 begins to rotate anti-clockwise in FIG. 3, the stopper body 39 is pressed down backward against the spring not shown in the stopper 35. More specifically, the inclined face 40*b* in the locking section 40 of the stopper body 39 is pressed by the reaction force created by the right edge of the through-hole 36*b* in the rotation member 33 being stopped. As a result, the stopper body 39 is pushed backward, and is temporarily withdrawn from the through-hole 36*b*. When the product delivery drum 21 is further rotated, the product S for sale is abutted against the product holding member 34 and pushed by the weight of the product S for sale. This permits the product holding member 34 to be rotated anti-clockwise toward the delivery position P2. Consequently, the rotation member 33 is slightly rotated anti-clockwise against the pulling spring 37*a* to permit the locking section 40 in the stopper body 39 to be again engaged with the through-hole 36*b* in the rotation member 33, as shown in FIG. 6. As a result, the product holding member 34 pressed by the weight of the product S for sale, when rotated at a predetermined angle to the product delivery drum 21, is stopped. While maintaining this state, upon the subsequent rotation of the product delivery drum 21, the product holding member 34 is rotated toward the delivery position P2. When the product delivery drum 21 is further rotated to deliver the product S for sale to the enlarged-width section 20, the product holding member 34 holds the product S for sale until the next selling product supporting face 32 in the product delivery drum 21 supports the product for next sale.

Thus, since the product holding member 34 rotated from the stand-by position P1 toward the delivery position P2 at the time of selling holds the product S for sale until the next selling product supporting face 32 supports the product for next sale, the product for next sale is kept in such a state that the product for next sale is stacked on top of the product S for sale and is supported from the underside of the product for next sale by the product S for sale, thereby preventing falling to an extent more than necessary. That is, at the time of selling, even though the product for next sale approaches the selling product supporting face 31, the distance between the product for next sale and the rotation axis 22 does not become shorter than the distance between the next selling product supporting face 32 and the rotation axis 22. Therefore, the product for next sale is not caught in the end of the selling product supporting face 31. This permits the product delivery drum 21 to be smoothly rotated to properly deliver the product S for sale.

As shown in FIGS. 3 and 5, the entry inhibition mechanism 25 comprises: an entry inhibition member 42 which, under stand-by condition, is housed in a case 41 disposed between the guide wall 16 and the enlarged-width plate 19, and, at the time of selling, is vertically moved to inhibit the entry of the product for next sale into the enlarged-width section 20; a cam disk 43 which is mounted on the front face of the product delivery drum 21 and is provided with a cam groove having a predetermined shape (not shown); a connection plate 45 having a predetermined shape which is engaged with the cam disk 43 in its cam groove and is connected to the entry inhibition member 42 through a pin 44; and the like.

The entry inhibition member 42 is formed of a laterally long rectangular metal plate, and a plurality of portions at the lower part of the metal plate are properly cut out while leaving a plurality of portions remaining uncut as downward projected projections 42*a*. The lower end of each projection 42*a* is bent toward the left. These projections 42*a* are engaged with a plurality of openings (not shown) in the bottom of the case 41 and the enlarged-width plate 19 provided so as to correspond to the projections 42*a*. The entry inhibition member 42 is constructed so that, while the projections 42*a* are guided to these openings, the entry inhibition member 42 is vertically movable between a retraction position Q1 where the entry inhibition member 42 is retracted from the enlarged-width section 20 and is substantially accommodated into the case 41 (see FIGS. 3 and 8A) and a projection position Q2 where the entry inhibition member 42 is projected into the enlarged-width section 20 to such an extent as will be substantially the same as the projection length of the projection 42*a* (see FIG. 8C). A rod 46 extended in the front and back directions is fixed on cut-and-lift portions 42*b*, 42*b* which have been cut and lifted normal to the left direction in the front and back portions of the entry inhibition member 42. The pin 44 of the connection plate 45 is connected to the rod 46.

The connection plate 45 is formed of a metal plate in a rectangular frame form, and left and right edges 45*a*, 45*a* are bent normal to the forward direction. The left and right edges 45*a*, 45*a* are engaged with vertically extended guide grooves not shown. The connection plate 45 can be vertically smoothly moved along the guide grooves. Through-holes 45*b*, 45*b* are provided at the upper end of the connection plate 45 so as to be symmetrical with respect to the left and the right, and through-holes 45*c*, 45*c* are provided at the lower end of the connection plate 45 so as to be symmetrical with respect to the left and the right. The pin 44 connected to the rod 46 is fixed in the left upper through-hole 45*b*. On the other hand, a pin (not shown) engaged with the cam groove in the cam disk 43 is fixed in the right lower through-hole 45*c*.

In the entry inhibition mechanism 25 having the above construction, at the time of selling, as soon as the cam disk 43 is rotated upon the rotation of the product delivery drum 21, the connection plate 45 is vertically moved following the cam grooves. In this case, when the connection plate 45 is moved downward, the entry inhibition member 42 is moved downward from the retraction position Q1 toward the projection position Q2. This narrows the width in the vertical direction of the upstream end of the enlarged-width section 20, whereby the entry of the product for next sale into the enlarged-width section 20 is inhibited. As a result, at the time of selling, the erroneous entry of the product for next sale into the enlarged-width section 20 can be surely prevented. The so-called "delivery of two products at a time" can be surely prevented wherein two products are delivered in a single selling operation.

Figure 8:
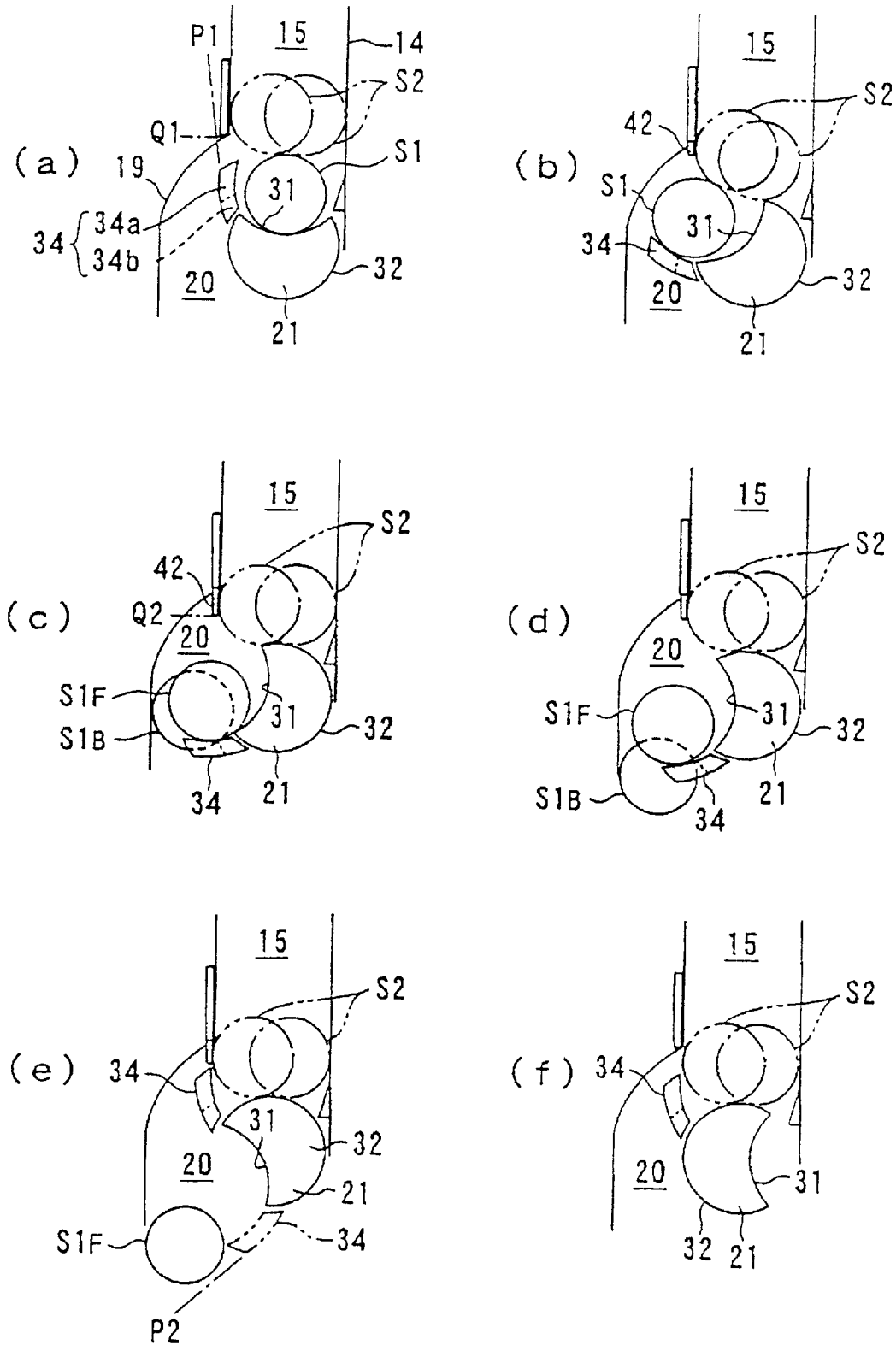
FIG. 8 is a typical explanatory view of the delivery of thin can products.

Next, the delivery of the product S for sale by the product delivery apparatus 4 having the above construction will be described with reference to FIG. 8 which is a typical diagram showing the delivery of thin can products (diameter 53 mm). The following description will be given on the assumption that the product passage 15 is divided into two parts, the front passage and the back passage, which respectively store products. In the following description, the product for sale and the product for next sale will be indicated respectively by symbols "S1" and "S2." Further, when the product S1 for sale stored in the front passage of the product passage 15 is distinguished from the product S1 for sale stored in the back passage, suffix letters "F" and "B" are added respectively to S1 for the product for sale stored in the front passage and S1 for the product for sale stored in the back passage.

FIG. 8A shows usual stand-by condition. The product delivery drum 21 is located in a home position. In the product delivery drum 21 located in the home position, the selling product supporting face 31 faces upward, and supports the product S1 for sale stored in the product passage 15 from the underside of the product S1 in such a state that the lower part of the product S1 is accommodated in the selling product supporting face 31. On the other hand, the product S2 for next sale is stored in such a state that the product S2 is located near the left side or the right side of the product passage 15 and is stacked on the top of the product S1 for sale. In this case, the product holding member 34 is located at the stand-by position P1, while the entry inhibition member 42 is located at the retraction position Q1. As shown in FIG. 6, the locking section 40 in the stopper body 39 of the product holding mechanism 24 is inserted and engaged with the through-hole 36*b* of the rotation member 33.

Upon the transition from stand-by condition to selling condition, the product delivery drum 21 first begins to rotate anti-clockwise. This permits the product S1 for sale to be delivered toward the product holding member 34. As soon as the product S1 for sale is abutted against the product holding member 34, the product holding member 34 is pushed by the weight of the product S1 for sale toward the delivery position P2 and consequently is rotated at a predetermined angle to the product delivery drum 21. While this state is maintained by the stopper 35, the product holding member 34 is rotated toward the delivery position P2 upon the rotation of the product delivery drum 21.

Even when the product delivery drum 21 is further rotated to deliver the product S1 for sale to the enlarged-width section 20, as shown in FIG. 8B, the product S2 for next sale remains supported from its underside by the product S1 for sale held by the product holding member 34 until the end of the next selling product supporting face 32 reaches beneath the product S2 for next sale. As shown in FIG. 8C, upon further rotation of the product delivery drum 21, the product S2 for next sale is supported from its underside by the next selling product supporting face 32 in the product delivery drum 21, while the product S1 for sale is separated from the product S2 for next sale. Further, in this case, downward movement of the entry inhibition member 42 from the retraction position Q1 toward the projection position Q2 narrows the width in the vertical direction of the upstream end of the enlarged-width section 20. This can inhibit the entry of the product S2 for next sale into the enlarged-width section 20.

As shown in FIG. 8D, upon further rotation of the product delivery drum 21, the product S1B for sale stored in the back passage of the product passage 15 is permitted to be passed through the enlarged-width section 20, and only the product S1B for sale is dropped and delivered. As soon as the delivery of the product S1B for sale is detected by a product sensor (not shown) provided below the enlarged-width section 20, the rotation of the product delivery drum 21 is stopped, leading to temporary stand-by condition. The delivered product S1B for sale is carried out through a chute 5 (see FIG. 1) provided below the product delivery apparatus 4 to a product output port not shown.

Thereafter, in the next sale, as soon as the temporary stand-by condition is again changed to the selling condition, the product delivery drum 21 being stopped at the position of rotation shown in FIG. 8D again begins to rotate anti-clockwise. As soon as the product S1F for sale stored in the front passage of the product passage 15 is permitted to be passed through the enlarged-width section 20, as shown in FIG. 8E, the product S1F for sale is dropped and delivered. In this case, upon the delivery of the product S1F for sale, the pressing of the product S1F for sale against the product holding member 34 is released. This permits the product holding member 34 to be returned from the delivery position P2 to the stand-by position P1 by the pulling spring 37*a* through the rotation member 33. As shown in FIG. 8F, as soon as the product delivery drum 21 is further rotated anti-clockwise, the entry inhibition member 42 is moved from the projection position Q2 to the retraction position Q1 and, at the same time, the product delivery drum 21 is stopped in a home position shown in FIG. 8A. This completes the selling of the product S1F for sale and results in usual stand-by condition, and the product S2 for next sale is provided as the product S1 for sale.

Figure 9:
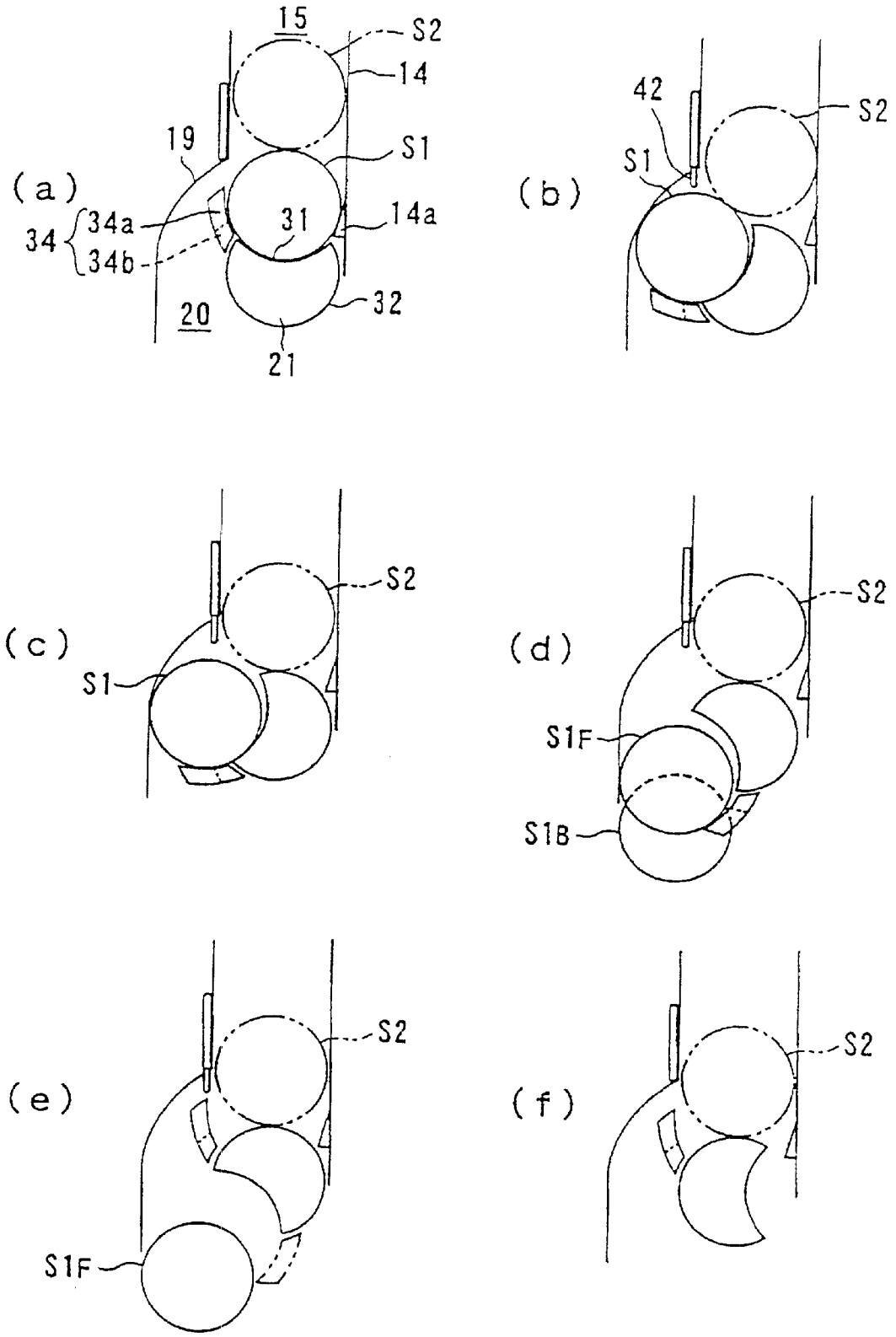
FIG. 9 is a typical explanatory view of the delivery of PET bottle products.
Figure 10:
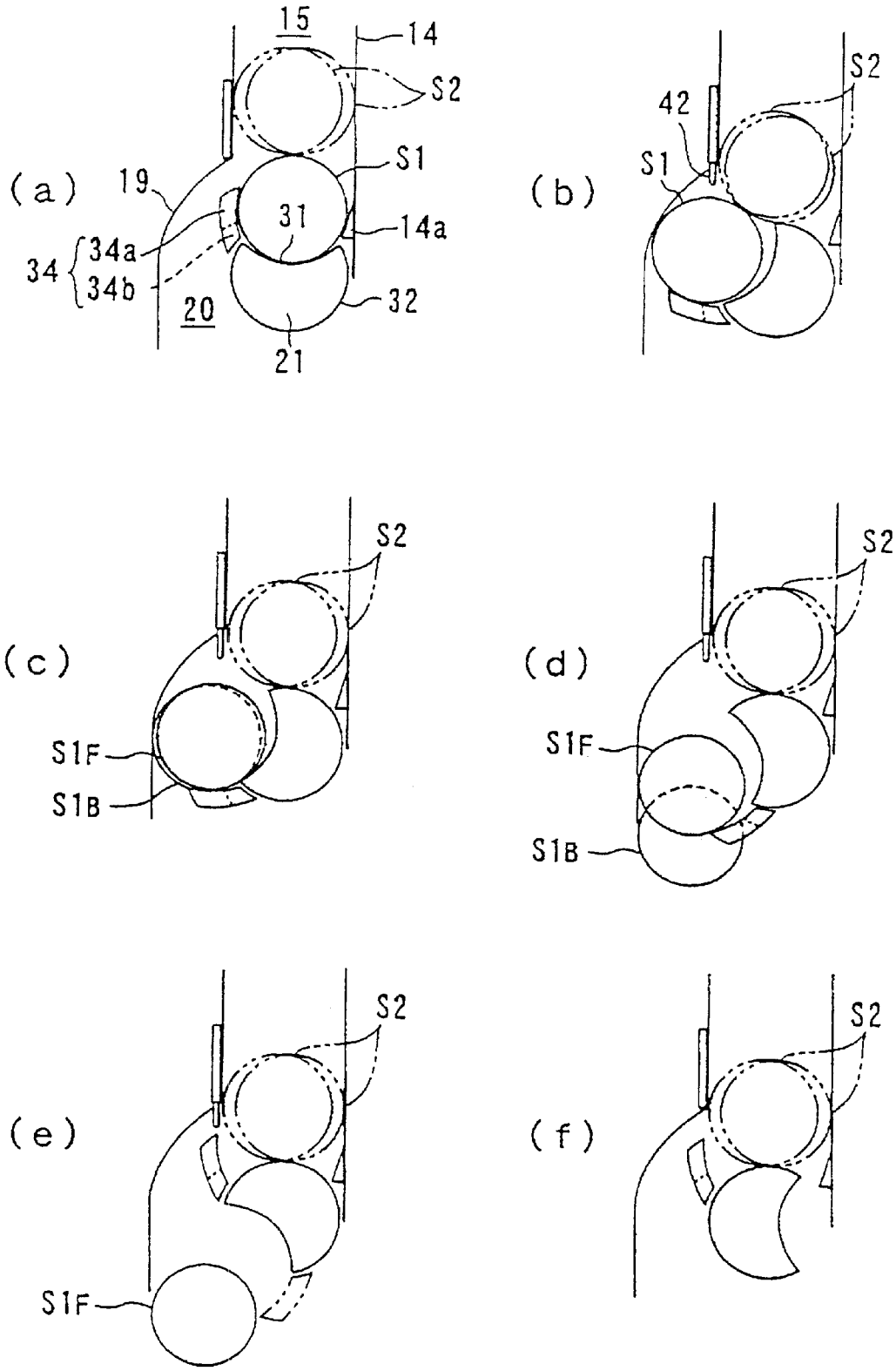
FIG. 10 is a typical explanatory view of the delivery of thick can products.
Figure 11:
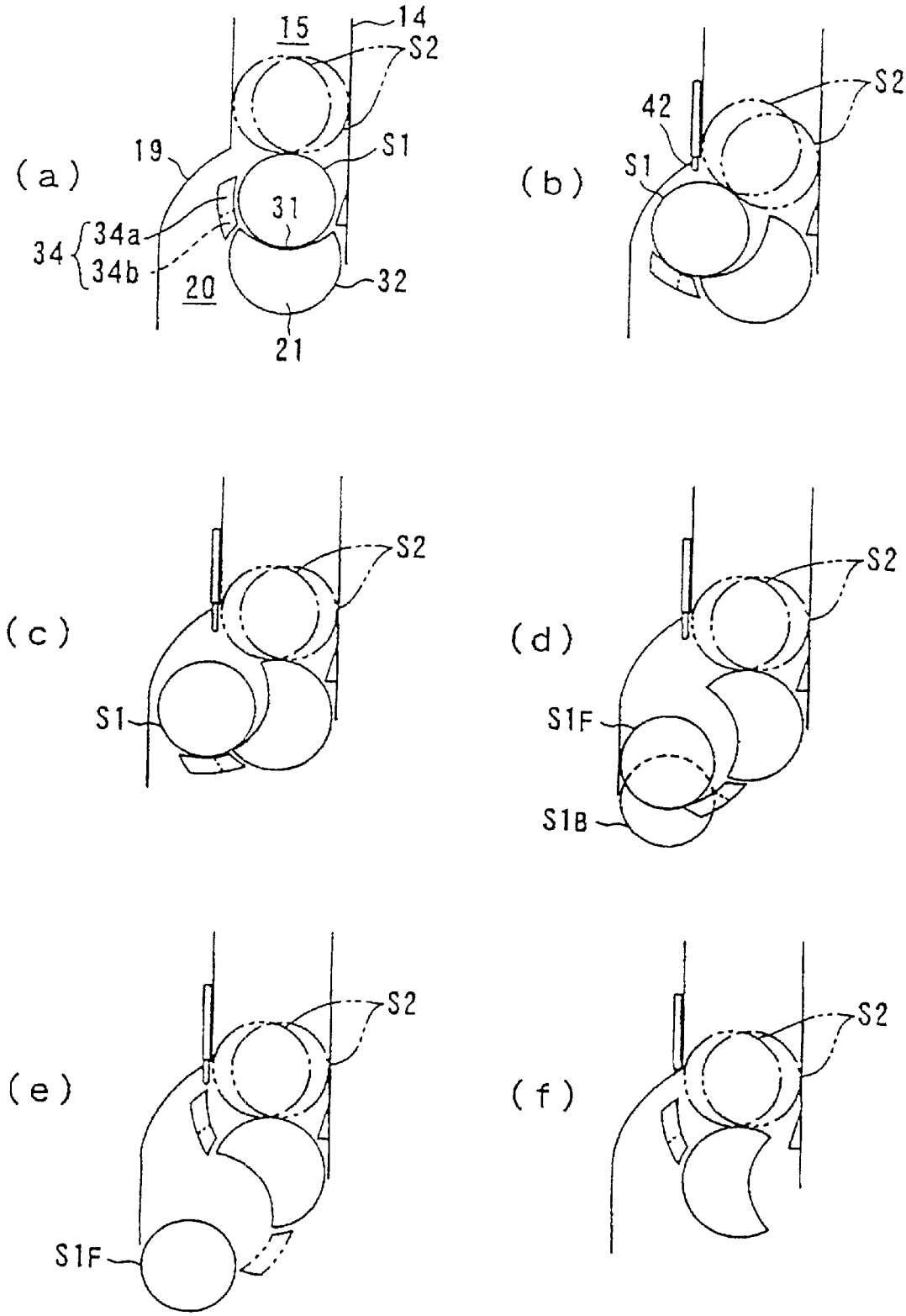
FIG. 11 is a typical explanatory view of the delivery of medium thick can products.

Next, the delivery of products having a diameter different from the thin can products will be briefly explained with reference to FIGS. 9 to 11. FIGS. 9, 10, and 11 show respectively the delivery of PET bottle products (maximum diameter 72 mm), thick can products (diameter 66 mm), and medium-thick can products (diameter 60 mm).

As shown in FIG. 9, in the case of a product S1 for sale as the PET bottle product, unlike the thin can products as described above, the lower part is slightly larger than a space defined by the selling product supporting face 31 of the product delivery drum 21 and the product holding member 34 located at the stand-by position P1. For this reason, as shown in FIG. 9A, when the product S1 for sale is supported on the selling product supporting face 31, the product holding member 34 is pushed by the product S1 for sale. This permits the product holding member 34 to be slightly rotated toward the delivery position P2 rather than toward the stand-by position P1. As a result, the space is automatically increased to a size suitable for the lower part of the product S1 for sale. By virtue of this, under usual stand-by condition, the product holding member 34 is in intimate contact with the product S1 for sale, and the product S1 for sale is properly supported by the selling product supporting face 31 and the product holding member 34. As shown in the same drawing, with the product delivery drum 21 being located between the enlarged-width section 20 and the partition wall 14, a guide member 14*a* having a predetermined shape is provided on the partition wall 14 remote from the enlarged-width section 20. The guide member 14*a* permits the product S1 for sale to be properly supported in such a state that the lower part of the product S1 for sale is accommodated in the selling product supporting face 31 of the product delivery drum 21.

At the time of the delivery of the product S1 for sale, as with the delivery of the thin can products, the product delivery drum 21 located in a home position shown in FIG. 9A is rotated anti-clockwise, and, as shown in FIGS. 9B and 9C, the product S1 for sale is held by the product holding member 34 until the next selling product supporting face 32 of the product delivery drum 21 supports a product S2 for next sale. Upon further rotation of the product delivery drum 21, as shown in FIG. 9D, the product S1B for sale stored in the back passage is delivered, and, at the time of next selling, as shown in FIG. 9E, the product S1F for sale stored in the front passage is delivered. Upon the delivery of the product S1F for sale, the product holding member 34 is returned to the stand-by position P1, and, in addition, as shown in FIGS. 9F and 9A, the product delivery drum 21 is further rotated anti-clockwise, and is returned to the home position.

The product S1 for sale shown in FIGS. 10 and 11 may also be delivered in the same manner as described above in connection with the delivery of the thin can products. Specifically, the product delivery drum 21 located in a home position shown in FIG. 10A (including FIG. 11; the same shall apply hereinafter) is rotated anti-clockwise, and, as shown in FIGS. 10B and 10C, the product S1 for sale is held by the product holding member 34 until the next selling product supporting face 32 supports the product S2 for next sale. Upon further rotation of the product delivery drum 21, as shown in FIG. 10D, the product S1B for sale is delivered, and, at the time of next selling, as shown in FIG. 10E, the product S1F for sale is delivered. As soon as the product S1F for sale is delivered, the product holding member 34 is returned to the stand-by position P1, and, in addition, as shown in FIGS. 10F and 10A, the product delivery drum 21 is further rotated anti-clockwise, and is returned to the home position. In the case of the product S1 for sale as the thick can product shown in FIG. 10, as with the PET bottle products shown in FIG. 9, under usual stand-by condition, the product holding member 34 is in intimate contact with the product S1 for sale, and the product S1 for sale is properly supported by the selling product supporting face 31 and the product holding member 34.

As is apparent from the foregoing detailed description, in the product delivery apparatus 4 according to this preferred embodiment, the rotation of the product delivery drum 21 in a predetermined direction permits the product S1 for sale to be delivered. This, unlike the prior art, can eliminate the need to use any solenoid, and can realize the production of the product delivery apparatus at a lower cost than the conventional product delivery apparatus provided in conventional serpentine columns. Further, for the product S1 for sale and the product S2 for next sale stored in the product passage 15, as described above, a certain range of diameter, which can be supported by the selling product supporting face 31 and the next selling product supporting face 32, suffices for good results. Therefore, unlike the prior art, various products having the certain range of diameter can be surely delivered one by one without use of any adapter.

Further, as soon as the product holding member 34 is rotated to a delivery position P2 to deliver the product S1 for sale, the product holding member 34 is driven from the delivery position P2 to the stand-by position P1 by the pulling spring 37*a*. Therefore, the product holding member 34 is not rotated beyond the delivery position P2 to a position opposite to the stand-by position P1. This can eliminate the need to provide a space for the rotation of the product holding member 34 to a position opposite to the enlarged-width section 20, that is, until the product delivery drum 21 is located between the enlarged-width section 20 and the product holding member 34. Therefore, the product delivery drum 21 can be disposed near the partition wall 14 side free from the enlarged-width plate 19. This can realize saving of a space of the product passage 15 around the product delivery drum 21.

Further, the product holding member 34 is constructed so as to be rotatable toward the delivery position P2 upon pressing by the weight of the product S1 for sale. Therefore, under stand-by condition and under selling condition, the product S1 for sale can be automatically properly held according to the size of the product S1 for sale. Further, since the projection length L1 of the first half portion 34*a* in the product holding member 34 is different from the projection length L2 of the second half portion 34*b* in the product holding member 34, the product S1F for sale stored in the front passage of the product passage 15 can be delivered at a rotation position of the product delivery drum 21 different from the rotation position of the product delivery drum 21 at which the product S1B for sale is stored in the back passage of the product passage 15. As a result, two products can be sold before the product delivery drum 21 makes one revolution. Therefore, as compared with selling of one product for each revolution of the product delivery drum 21, this can reduce the power consumption for rotating the product delivery drum 21 at the time of selling.

The present invention is not limited to the above preferred embodiments, and may be carried out according to various embodiments. For example, the product delivery apparatus according to the present invention may be applied to serpentine columns. Further, it should be noted that, for example, the detailed construction of the product delivery drum, the product holding mechanism, and the entry inhibition mechanism is illustrative only, and variations and modifications can be properly effected within the scope of the present invention.

As is apparent from the foregoing detailed description, the product delivery apparatus for a vending machine according to the invention can be produced at a lower cost than the product delivery apparatus provided in conventional serpentine columns, and is advantageous, for example, in that products having various sizes can be surely delivered one by one without use of any adapter.

What is claimed is:

1. A product delivery apparatus for a vending machine, adapted for delivering downward a product for sale located lowermost at the time of selling among a plurality of products stored in such a state that they lie sideways and are vertically stacked on top of one another, said product delivery apparatus comprising:

a vertically extended product passage for storing the plurality of products, defined by two vertically extended passage walls which have been disposed so as to face each other while leaving a predetermined space therebetween;

a product delivery drum which is provided at the lower end of the product passage so as to be rotatable around an axis line horizontally extended in a direction orthogonal to the direction in which the two passage walls face each other and is extended along the axis line; and drive means which, at the time of selling, drives and rotates the product delivery drum at a predetermined angle to deliver the product for sale, said product delivery drum comprising: a first product supporting face which is disposed outside the axis line, is concaved in an arc form toward the axis line, and, under stand-by condition, supports the product for sale from the underside of the product for sale in such a state that the lower part of the product for sale is accommodated within the first product supporting face, while, at the time of selling, upon the rotation of the product delivery drum, the product for sale is delivered toward one of the two passage walls; and a second product supporting face which is continued from the first product supporting face, is extended concentrically with respect to the axis line, and, at the time of selling, supports a product for next sale from the underside of the product, located just above the product for sale, said product passage having an enlarged-width section at the lower end of one of the passage walls for permitting the passage of the product for sale;

which further comprises a product holding member which is constructed so as to be movable between a stand-by position facing, in a projected state, the enlarged-width section and a delivery position for permitting the passage of the product for sale, and, at the time of selling, is moved from the stand-by position toward the delivery position and holds the product for sale until the second product supporting face supports the product for next sale;

wherein the product holding member comprises: a first projection which extends along the axis line and is projected toward the enlarged-width section to a first projection length; and a second projection which is adjacent to the first projection, extends along the axis line, and is projected toward the enlarged-width section to a second projection length shorter than the first projection length;

wherein the product holding member comprises: a first projection which extends along the axis line and is projected toward the enlarged-width section to a first projection length; and a second projection which is adjacent to the first projection, extends along the axis line, and is projected toward the enlarged-width section to a second projection length shorter than the first projection length;

wherein the product passage is composed of two product passages each having the product delivery drum adjacent to each other, and said drive means comprises a single drive source and connection switch means which, at the time of selling, performs selective switching to one of the product delivery drums in the two product passages and connects the drive source to the selected product delivery drum.

2. A product delivery apparatus for a vending machine, adapted for delivering downward a product for sale located lowermost at the time of selling among a plurality of products stored in such a state that they lie sideways and are vertically stacked on top of one another, said product delivery apparatus comprising:

a vertically extended product passage for storing the plurality of products, defined by two vertically extended passage walls which have been disposed so as to face each other while leaving a predetermined space therebetween;

a product delivery drum which is provided at the lower end of the product passage so as to be rotatable around an axis line horizontally extended in a direction orthogonal to the direction in which the two passage walls face each other and is extended along the axis line; and drive means which, at the time of selling, drives and rotates the product delivery drum at a predetermined angle to deliver the product for sale, said product delivery drum comprising: a first product supporting face which is disposed outside the axis line, is concaved in an arc form toward the axis line, and, under stand-by condition, supports the product for sale from the underside of the product for sale in such a state that the lower part of the product for sale is accommodated within the first product supporting face, while, at the time of selling, upon the rotation of the product delivery drum, the product for sale is delivered toward one of the two passage walls; and a second product supporting face which is continued from the first product supporting face, is extended concentrically with respect to the axis line, and, at the time of selling, supports a product for next sale from the underside of the product, located just above the product for sale, said product passage having an enlarged-width section at the lower end of one of the passage walls for permitting the passage of the product for sale;

which further comprises a product holding member which is constructed so as to be movable between a stand-by position facing, in a projected state, the enlarged-width section and a delivery position for permitting the passage of the product for sale, and, at the time of selling, is moved from the stand-by position toward the delivery position and holds the product for sale until the second product supporting face supports the product for next sale;

which further comprises an entry inhibition member which is provided on one of the passage walls, is constructed so as to be movable between a position of retraction from the enlarged-width section and a position of projection toward the enlarged-width section, and, at the time of selling, upon the rotation of the product delivery drum, is moved from the retraction position to the projection position to inhibit the entry of the product for next sale into the enlarged-width section;

wherein the product passage is composed of two product passages each having the product delivery drum adjacent to each other, and said drive means comprises a single drive source and connection switch means which, at the time of selling, performs selective switching to one of the product delivery drums in the two product passages and connects the drive source to the selected product delivery drum.

3. A product delivery apparatus for a vending machine, adapted for delivering downward a product for sale located lowermost at the time of selling among a plurality of products stored in such a state that they lie sideways and are vertically stacked on top of one another, said product delivery apparatus comprising:

a vertically extended product passage for storing the plurality of products, defined by two vertically extended passage walls which have been disposed so as to face each other while leaving a predetermined space therebetween;

a product delivery drum which is provided at the lower end of the product passage so as to be rotatable around an axis line horizontally extended in a direction orthogonal to the direction in which the two passage walls face each other and is extended along the axis line; and drive means which, at the time of selling, drives and rotates the product delivery drum at a predetermined angle to deliver the product for sale, said product delivery drum comprising: a first product supporting face which is disposed outside the axis line, is concaved in an arc form toward the axis line, and, under stand-by condition, supports the product for sale from the underside of the product for sale in such a state that the lower part of the product for sale is accommodated within the first product supporting face, while, at the time of selling, upon the rotation of the product delivery drum, the product for sale is delivered toward one of the two passage walls; and a second product supporting face which is continued from the first product supporting face, is extended concentrically with respect to the axis line, and, at the time of selling, supports a product for next sale from the underside of the product, located just above the product for sale, said product passage having an enlarged-width section at the lower end of one of the passage walls for permitting the passage of the product for sale;

which further comprises a product holding member which is constructed so as to be movable between a stand-by position facing, in a projected state, the enlarged-width section and a delivery position for permitting the passage of the product for sale, and, at the time of selling, is moved from the stand-by position toward the delivery position and holds the product for sale until the second product supporting face supports the product for next sale;

wherein the product holding member comprises: a first projection which extends along the axis line and is projected toward the enlarged-width section to a first projection length; and a second projection which is adjacent to the first projection, extends along the axis line, and is projected toward the enlarged-width section to a second projection length shorter than the first projection length; and further comprising an entry inhibition member which is provided on one of the passage walls, is constructed so as to be movable between a position of retraction from the enlarged-width section and a position of projection toward the enlarged-width section, and, at the time of selling, upon the rotation of the product delivery drum, is moved from the retraction position to the projection position to inhibit the entry of the product for next sale into the enlarged-width section.

4. The product delivery apparatus according to claim 3, wherein the product passage is composed of two product passages each having the product delivery drum and adjacent to each other, and said drive means comprises a single drive source and connection switch means which, at the time of selling, performs selective switching to one of the product delivery drums in the two product passages and connects the drive source to the selected product delivery drum.

5. A product delivery apparatus for a vending machine, adapted for delivering downward a product for sale located lowermost at the time of selling among a plurality of products stored in such a state that they lie sideways and are vertically stacked on top of one another, said product delivery apparatus comprising:

a vertically extended product passage for storing the plurality of products, defined by two vertically extended passage walls which have been disposed so as to face each other while leaving a predetermined space therebetween;

a product delivery drum which is provided at the lower end of the product passage so as to be rotatable around an axis line horizontally extended in a direction orthogonal to the direction in which the two passage walls face each other and is extended along the axis line; and drive means which, at the time of selling, drives and rotates the product delivery drum at a predetermined angle to deliver the product for sale, said product delivery drum comprising: a first product supporting face which is disposed outside the axis line, is concaved in an arc form toward the axis line, and, under stand-by condition, supports the product for sale from the underside of the product for sale in such a state that the lower part of the product for sale is accommodated within the first product supporting face, while, at the time of selling, upon the rotation of the product delivery drum, the product for sale is delivered toward one of the two passage walls; and a second product supporting face which is continued from the first product supporting face, is extended concentrically with respect to the axis line, and, at the time of selling, supports a product for next sale from the underside of the product, located just above the product for sale, said product passage having an enlarged-width section at the lower end of one of the passage walls for permitting the passage of the product for sale;

wherein the product passage is composed of two product passages each having the product delivery drum adjacent to each other, and said drive means comprises a single drive source and connection switch means which, at the time of selling, performs selective switching to one of the product delivery drums in the two product passages and connects the drive source to the selected product delivery drum.

6. The product delivery apparatus according to claim 5, 3, 1, or 2, wherein the product holding member is provided so as to be rotatable relative to the product delivery drum around the axis line, and which further comprised holding member drive means which drives the product holding member form the delivery position to the stand-by position.

7. The product delivery apparatus according to claim 6, wherein the product holding member is constructed to be rotatable toward the delivery position upon being pushed by the weight of the product for sale, a stopper is further provided which inhibits the rotation of the product holding member toward the delivery position at a predetermined angle or more to the product delivery drum, and said holding member drive means is formed of a spring which energizes the product holding member to the stand-by position.

* * * * *